US011034161B2

(12) United States Patent
Yada et al.

(10) Patent No.: US 11,034,161 B2
(45) Date of Patent: Jun. 15, 2021

(54) PRINTER

(71) Applicant: FUJITSU COMPONENT LIMITED, Tokyo (JP)

(72) Inventors: Yuji Yada, Tokyo (JP); Hiromi Ohtsuka, Tokyo (JP); Tatsuya Oguchi, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 16/827,905

(22) Filed: Mar. 24, 2020

(65) Prior Publication Data

US 2020/0307250 A1 Oct. 1, 2020

(30) Foreign Application Priority Data

Mar. 29, 2019 (JP) ..... JP2019-066582

(51) Int. Cl.
*B41J 25/34* (2006.01)
*B41J 2/335* (2006.01)

(52) U.S. Cl.
CPC ..... *B41J 2/335* (2013.01); *B41J 25/34* (2013.01)

(58) Field of Classification Search
CPC .... B41J 2/335; B41J 2/33505; B41J 2202/31; B41J 2/32; B41J 2/33575; B41J 25/34
See application file for complete search history.

(56) References Cited

U.S. PATENT DOCUMENTS

| | | | | |
|---|---|---|---|---|
| 4,342,040 | A * | 7/1982 | Fujita | H04N 1/032 347/197 |
| 9,545,800 | B2 * | 1/2017 | Murata | B26D 1/065 |
| 2005/0117953 | A1 * | 6/2005 | Campanini | B41J 2/32 400/120.16 |
| 2020/0238740 | A1 * | 7/2020 | Yada | B41J 2/32 |

FOREIGN PATENT DOCUMENTS

| | | | | |
|---|---|---|---|---|
| JP | H02-144454 U | | 12/1990 | |
| JP | 07-256978 | * | 10/1995 | B41J 25/316 |
| JP | H09-216436 | | 8/1997 | |
| JP | 2016-120708 | * | 7/2016 | B41J 25/304 |

* cited by examiner

*Primary Examiner* — Huan H Tran
(74) *Attorney, Agent, or Firm* — Ipusa, PLLC

(57) ABSTRACT

A printer includes a print head that performs printing on a recording medium, a frame, a platen roller attached to the frame, a head spring that biases the print head toward the platen roller, a hook provided on a facing surface of the frame facing a back surface of the print head, and a support provided at an end of the head spring and attached to the hook. The head spring is rotatable about the support.

4 Claims, 12 Drawing Sheets

PRINTER

CROSS-REFERENCE TO RELATED APPLICATION

The present application is based on and claims priority to Japanese Patent Application No. 2019-066582, filed on Mar. 29, 2019, the entire contents of which are incorporated herein by reference.

BACKGROUND

1. Field

An aspect of this disclosure relates to a printer.

2. Description of the Related Art

Printers are widely used, for example, for cash registers in shops and mobile receipt issuing devices. In a printer, information is printed on a recording medium sandwiched between a print head and a platen roller (see, for example, Japanese Unexamined Utility Model Application Publication No. 02-144454 and Japanese Unexamined Patent Application Publication No. 09-216436).

The print head is pressed by a head spring against the platen roller, and therefore it is not easy to detach the print head and attach a replacement print head. Also, the head spring may be lost when the print head is detached.

For the above reason, there is a demand for a printer including a print head that can be easily replaceable without losing a head spring.

SUMMARY

In an aspect of this disclosure, there is provided a printer including a print head that performs printing on a recording medium, a frame, a platen roller attached to the frame, a head spring that biases the print head toward the platen roller, a hook provided on a facing surface of the frame facing a back surface of the print head, and a support provided at an end of the head spring and attached to the hook. The head spring is rotatable about the support.

DESCRIPTION OF EMBODIMENTS

An aspect of this disclosure provides a printer including a print head that can be easily replaceable without losing a head spring.

Embodiments of the present invention are described below with reference to the accompanying drawings. Throughout the drawings, the same reference number is assigned to the same component, and repeated descriptions of the same component are omitted. In the present application, an X1-X2 direction, a Y1-Y2 direction, and a Z1-Z2 direction indicate directions that are orthogonal to each other.

Figure 1:
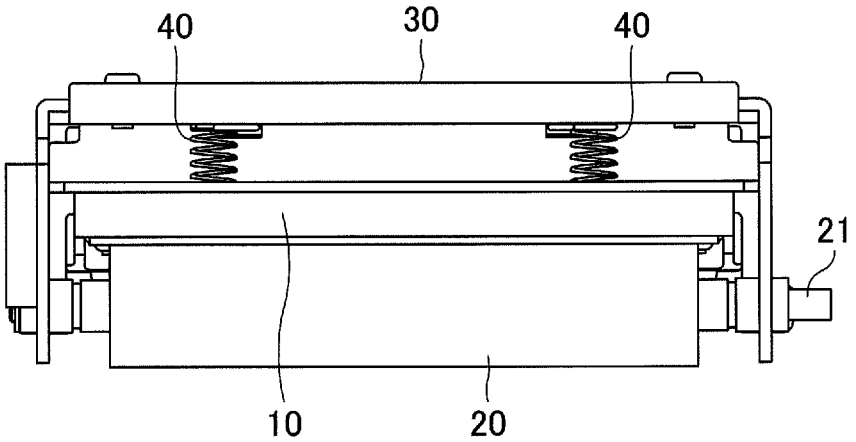
FIG. 1 is a top view of a printer.

Replacement of a print head is described below with reference to FIG. 1.

The printer includes a print head 10, a platen roller 20, a frame 30, and head springs 40. The printing surface of the print head 10 is disposed to face the platen roller 20, and is biased by the head springs 40 toward the platen roller 20. A recording medium is fed by the platen roller 20.

The print head 10 is a thermal head. Heating elements of the print head 10 corresponding to print areas generate heat, and change colors of heated portions of thermal paper. Because the print head 10 and the recording medium directly contact each other, the surface of the print head 10 may be rubbed by the recording medium and become worn as a result of repeated printing. Further, when printing is performed on label paper having a back surface with an adhesive, the adhesive may stick to the print head 10 and become hardened and unremovable due to heat. Other foreign matter may adhere to the adhesive and become unremovable. Therefore, the print head 10 needs to be replaced as necessary.

Because the print head 10 is pressed against the platen roller 20 by the head springs 40, it is difficult to detach and attach the print head 10 to replace the print head 10.

Also, if the head springs 40 are coil springs, there is a risk that the head springs 40 are lost when the print head 10 is detached.

Embodiments of the present invention make it possible to solve these problems.

First Embodiment

Figure 2:
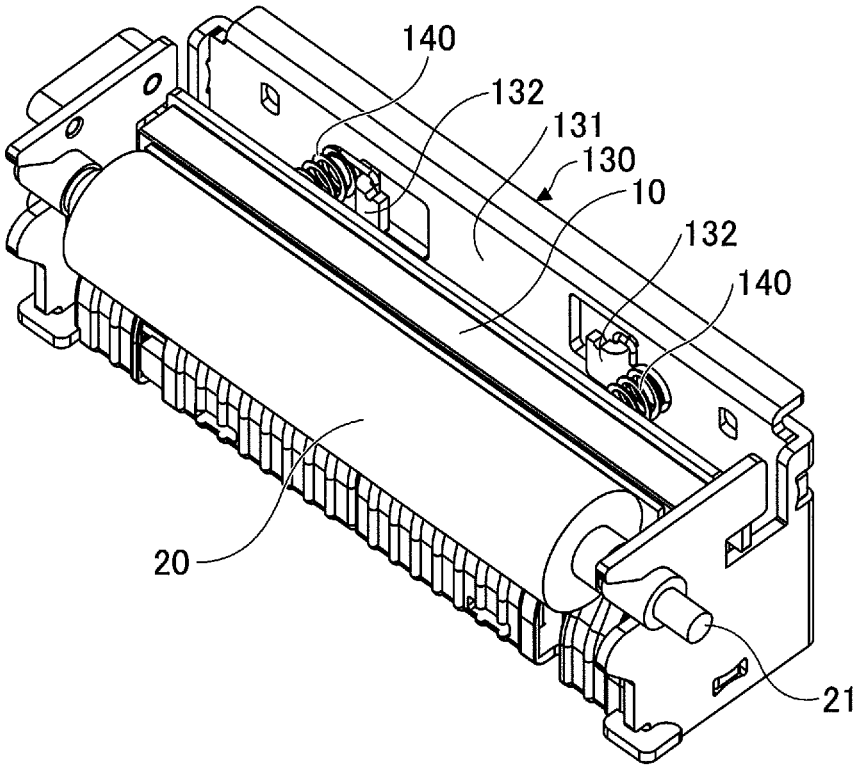
FIG. 2 is a perspective view of a printer according to a first embodiment.
Figure 3:
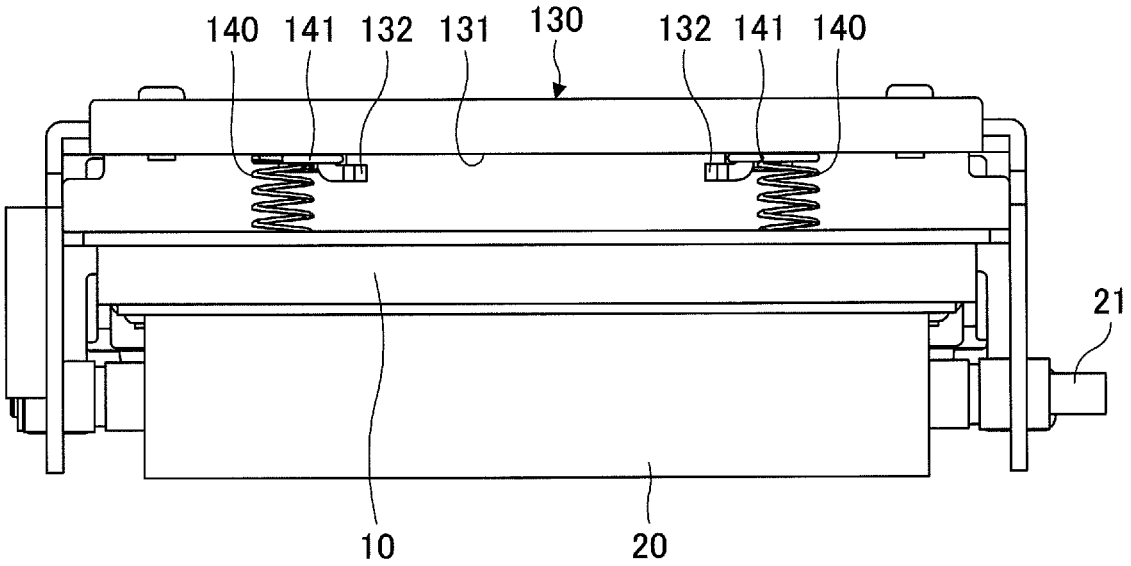
FIG. 3 is a top view of the printer of the first embodiment.

A printer according to a first embodiment is described with reference to FIGS. 2 and 3. FIG. 2 is a perspective view and FIG. 3 is a top view of the printer of the present embodiment.

The printer of the present embodiment is a thermal printer and includes a print head 10, a platen roller 20, a frame 130, and head springs 140. The platen roller 20 is attached to the frame 130 so as to be rotatable about a rotation shaft 21. The print head 10 is disposed such that its printing surface faces the platen roller 20, and is pressed toward the platen roller 20 by the head springs 140 disposed between the print head 10 and the frame 130. A recording medium sandwiched between the print head 10 and the platen roller 20 is fed by the platen roller 20.

Figure 4:
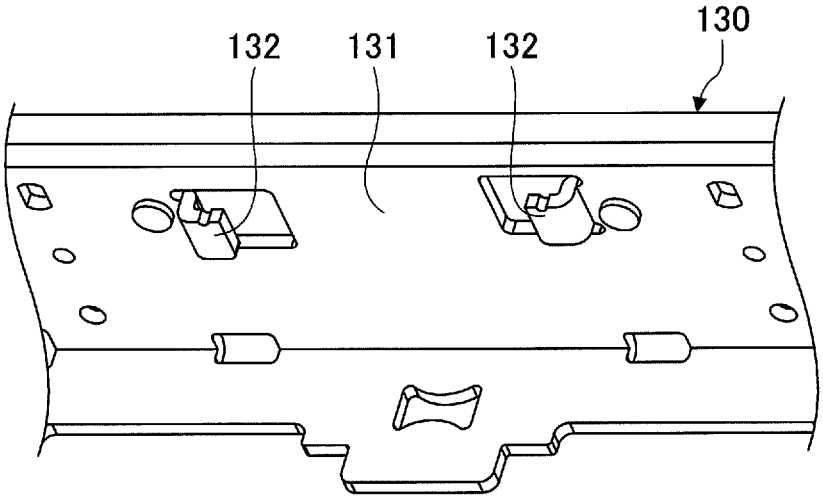
FIG. 4 illustrates a frame of the first embodiment.

As illustrated in FIG. 4, hooks 132 for supporting the head springs 140 are provided on a facing surface 131 of the frame 130 facing the back surface of the print head 10. Each hook 132 has a shape protruding toward the print head 10.

Figure 5:
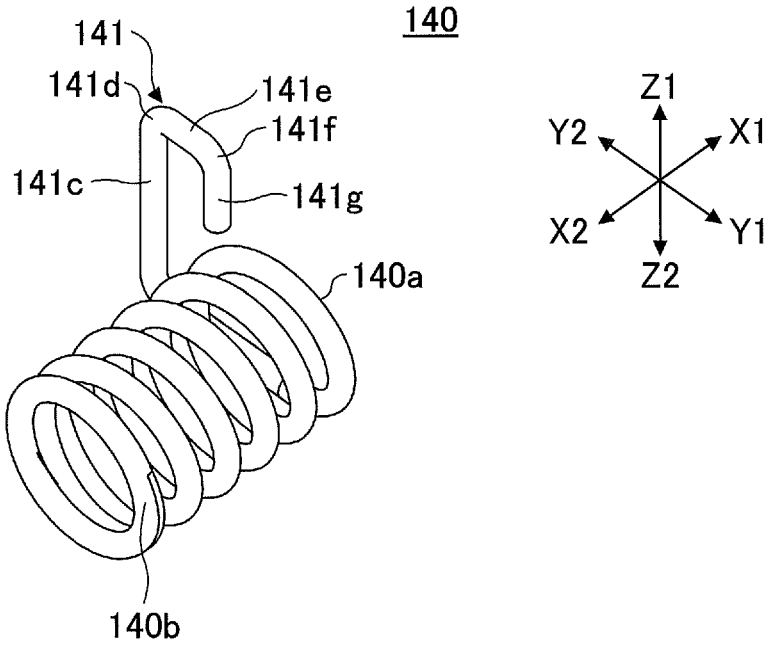
FIG. 5 illustrates a head spring of the first embodiment.
Figure 6:
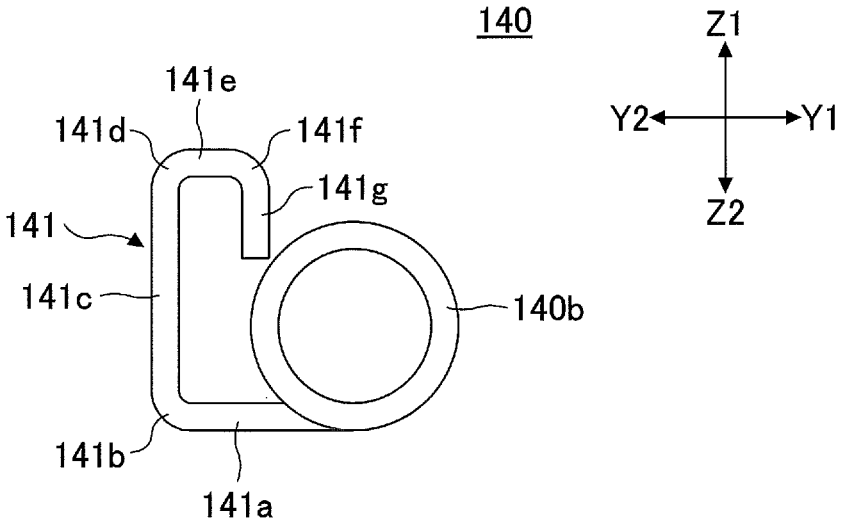
FIG. 6 illustrates the head spring of the first embodiment.

The head springs 140 are described with reference to FIGS. 5 and 6. Each head spring 140 is a coil spring. The head spring 140 expands and contracts in its axial direction, the X1-X2 direction in FIGS. 5 and 6. The head spring 140 is attached to the printer such that an X1-side end 140*a* faces the frame 130 and an X2-side end 140*b* contacts the back surface of the print head 10, and is contracted in the X1-X2 direction to press the print head 10 toward the platen roller 20. A support 141 to be attached to the hook 132 is provided at the end 140*a*. The support 141 is bent in the YZ plane and includes a first extending part 141*a*, a first bent part 141*b*, a second extending part 141*c*, a second bent part 141*d*, a third extending part 141*e*, a third bent part 141*f*, and a fourth extending part 141*g*.

The extending part 141*a* extends linearly in the Y2 direction from the end 140*a* and is bent at substantially right angle in the Z1 direction at the bent part 141*b* to form the extending part 141*c* that extends linearly. The extending part 141*c* is bent at substantially right angle in the Y1 direction at the bent part 141*d* to form the extending part 141*e*. Further, the extending part 141*e* is bent at substantially right angle in the Z2 direction at the bent part 141*f* to form the extending part 141*g*.

The extending part 141*a* and the extending part 141*e* are parallel to the Y1-Y2 direction, and the extending part 141*c* and the extending part 141*g* are parallel to the Z1-Z2 direction.

In the present embodiment, the extending part 141*c* is placed inside of the hook 132 so that the head spring 140 is supported by the frame 130. With this configuration, even when the print head 10 is detached, the head spring 140 is not detached from the frame 130, and it is possible to prevent the head spring 140 from being lost. The axial direction of the head spring 140 is substantially orthogonal to the Z1-Z2 direction in which the extending part 141*c* extends.

According to the present embodiment, the head spring 140 can be rotated around the extending part 141*c* placed inside of the hook 132. When attaching and detaching the print head 10, the head spring 140 can be rotated so that the biasing force of the head spring 140 is not applied to the print head 10 and the print head 10 can be easily detached and attached.

FIGS. 2 and 3 illustrate a state where the print head 10 is pressed by the head springs 140 toward the platen roller 20 and printing can be performed on a recording medium. In this state, the axial direction of each head spring 140 is substantially orthogonal to the surface 131.

Figure 7:
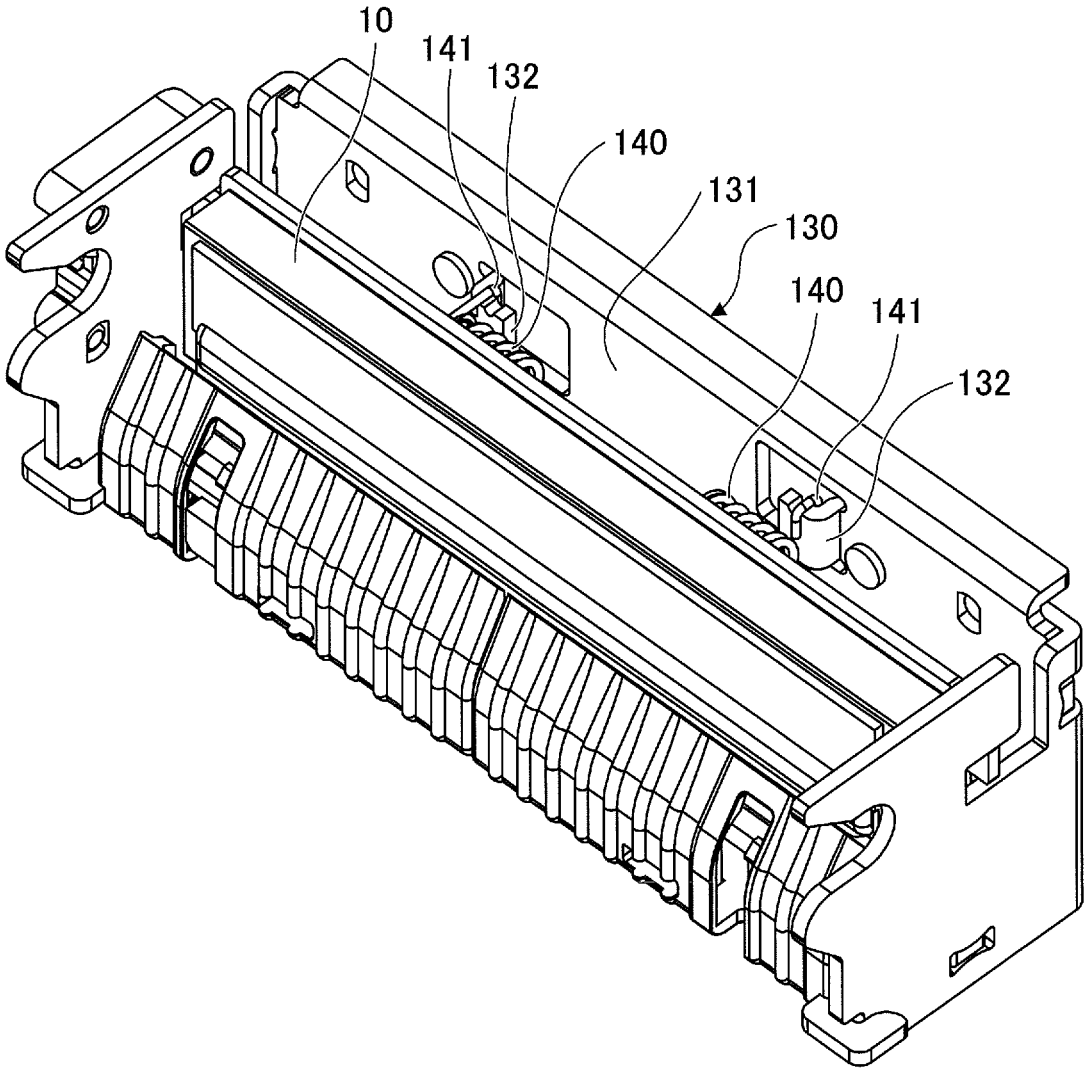
FIG. 7 illustrates the printer of the first embodiment.
Figure 8:
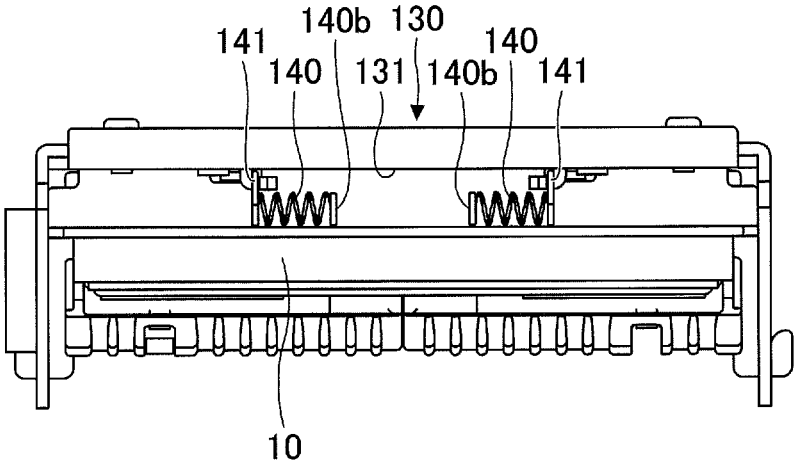
FIG. 8 illustrates the printer of the first embodiment.

FIG. 7 is a perspective view and FIG. 8 is a top view of the printer where the head springs 140 are rotated. FIGS. 7 and 8 illustrate a state where the platen roller 20 is detached from the frame 130. When detaching the print head 10, each head spring 140 is rotated 90 degrees about the extending part 141*c* as illustrated in FIGS. 7 and 8 so that the biasing force of the head spring 140 is not applied to the print head 10. In this state, the axial direction of the head spring 140 is parallel to the surface 131.

In the state illustrated in FIGS. 7 and 8, the end 140*b* is out of contact with the back surface of the print head 10, and the biasing force of the head spring 140 is not applied to the print head 10. In this state, the print head 10 can be easily detached as illustrated in FIG. 9.

Figure 9:
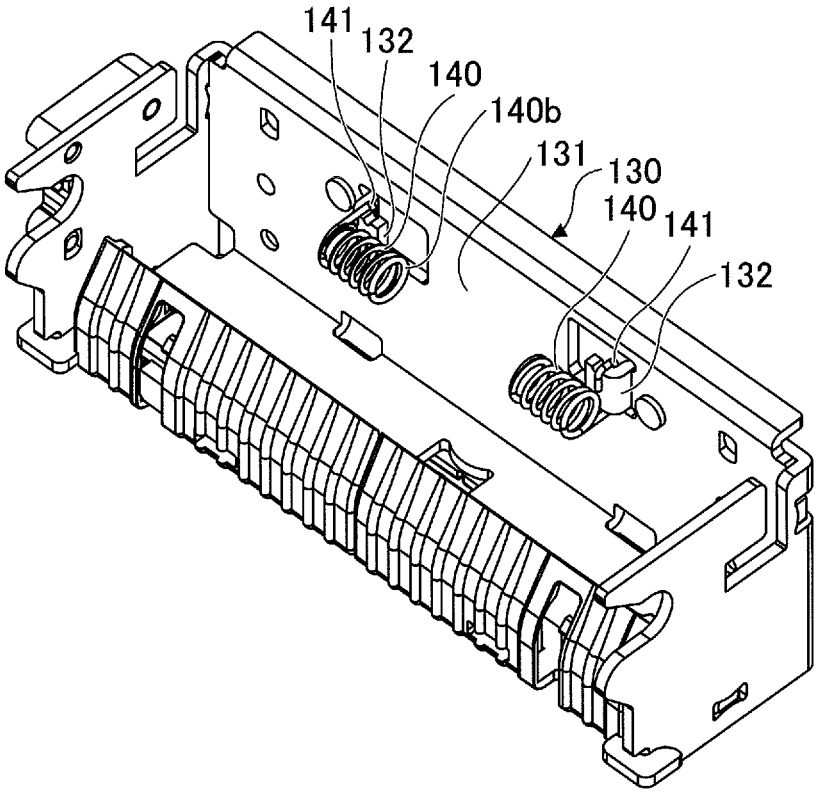
FIG. 9 illustrates the printer of the first embodiment.
Figure 10:
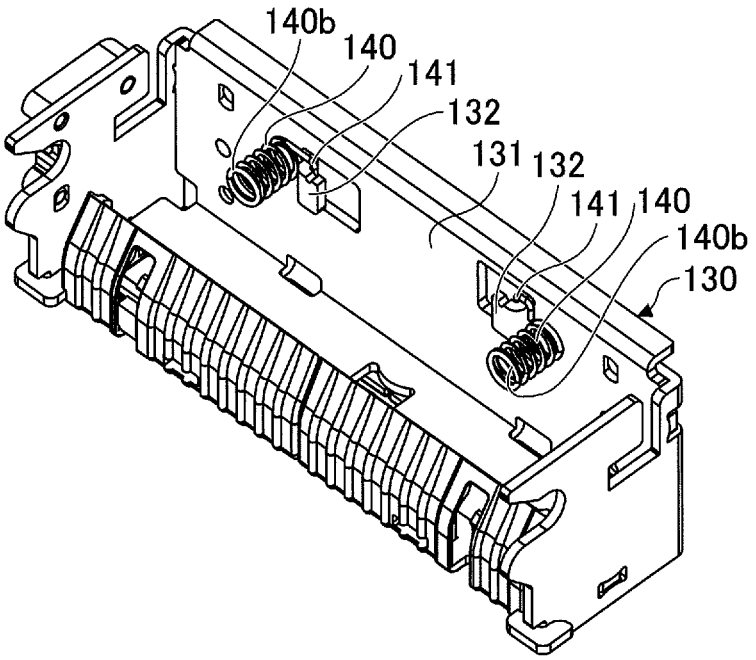
FIG. 10 illustrates the printer of the first embodiment.

FIG. 10 illustrates a state where the head spring 140 is rotated from the state in FIG. 9. In FIG. 10, the print head 10 is omitted to clearly illustrate the relationship between the hook 132 and the support 141. When attaching the print head 10 in the state illustrated in FIG. 9, the print head 10 is placed in the frame 130, and each head spring 140 is rotated around the extending part 141*c* so that the biasing force of the head spring 140 is applied to the print head 10 as illustrated in FIGS. 2 and 3. With this configuration the print head 10 can be easily attached.

Second Embodiment

Figure 11:
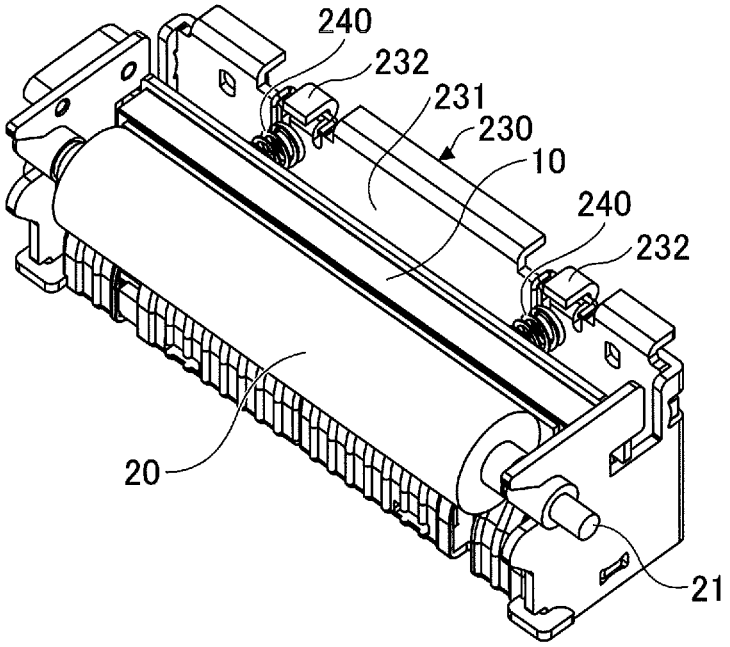
FIG. 11 is a perspective view of a printer of a second embodiment.
Figure 12:
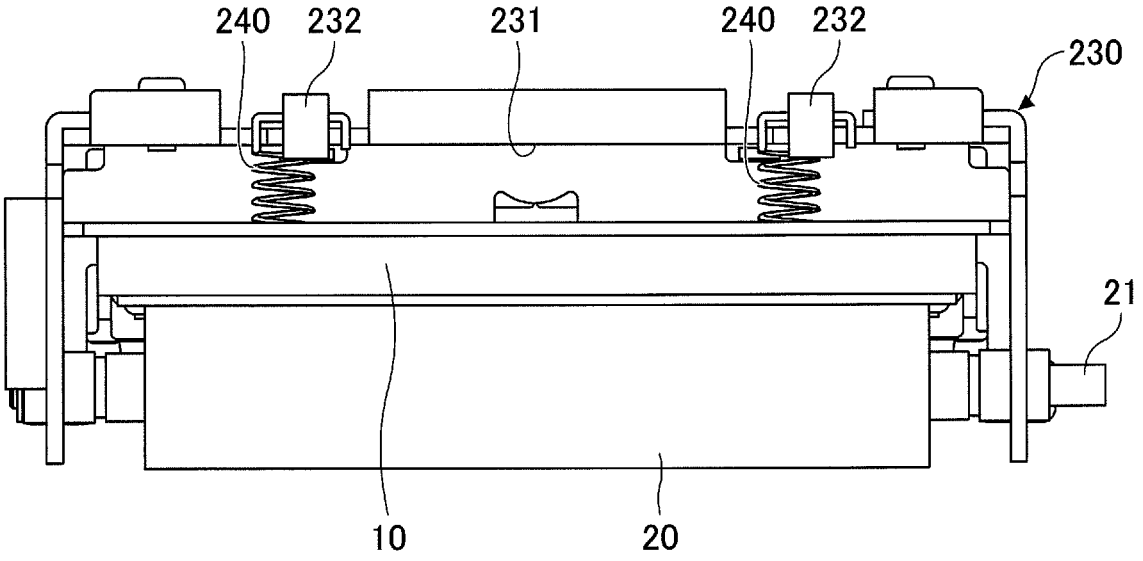
FIG. 12 is a top view of the printer of the second embodiment.
Figure 13:
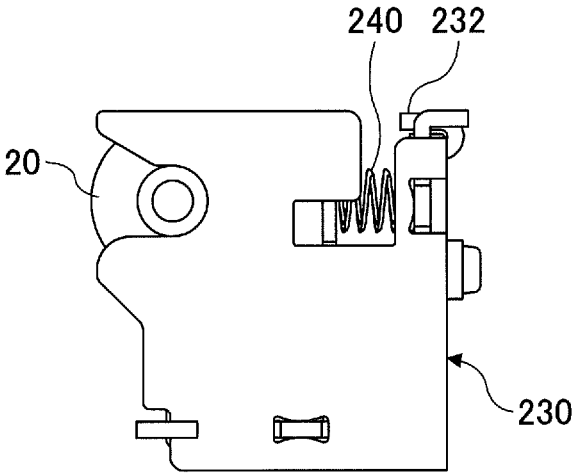
FIG. 13 is a side view of the printer of the second embodiment.

A printer according to a second embodiment is described with reference to FIGS. 11 through 13. FIG. 11 is a perspective view, FIG. 12 is a top view, and FIG. 13 is a side view of the printer of the second embodiment.

The printer in the second embodiment includes a print head 10, a platen roller 20, a frame 230, and head springs 240. The platen roller 20 is rotatably attached to the frame 230. The back surface of the print head 10 is pressed toward the platen roller 20 by the head springs 240.

Figure 14:
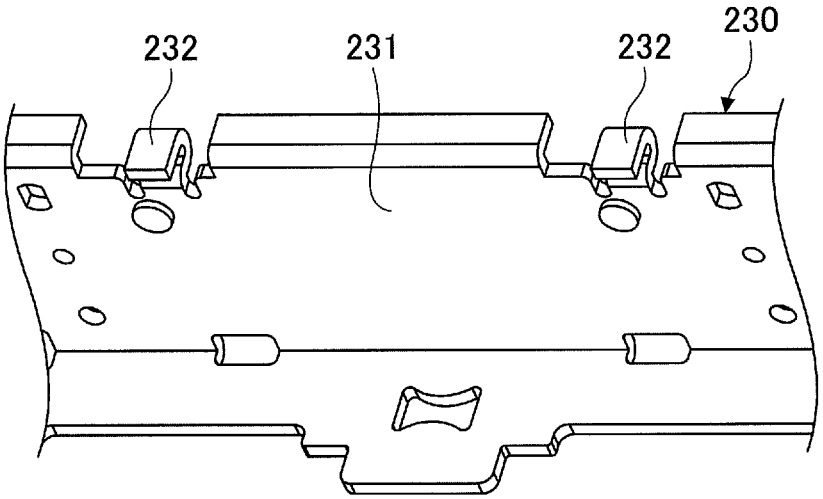
FIG. 14 illustrates a frame of the second embodiment.

As illustrated in FIG. 14, hooks 232 for supporting the head springs 240 are provided on the upper side of a surface 231 of the frame 230 facing the back surface of the print head 10.

Figure 15:
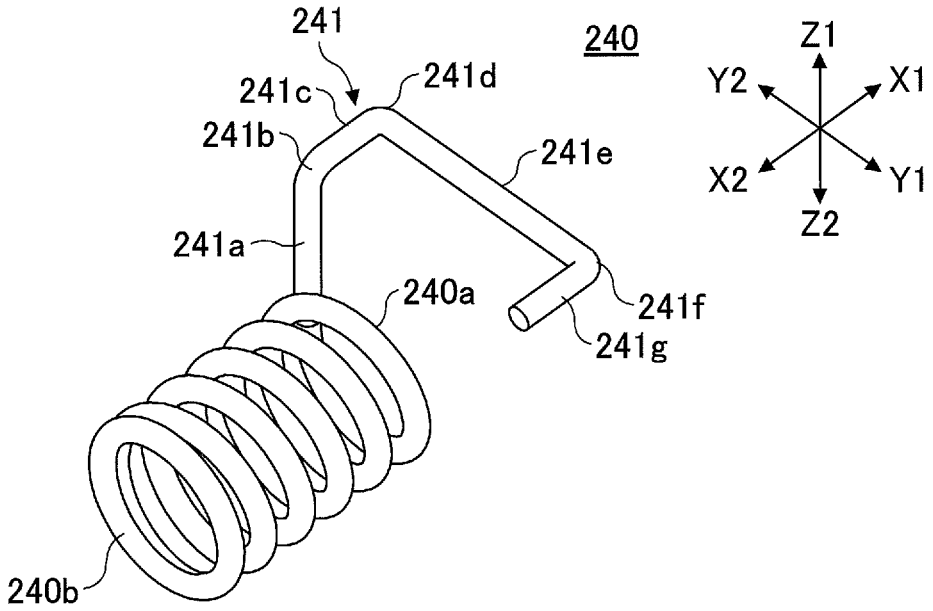
FIG. 15 illustrates a head spring of the second embodiment.
Figure 16:
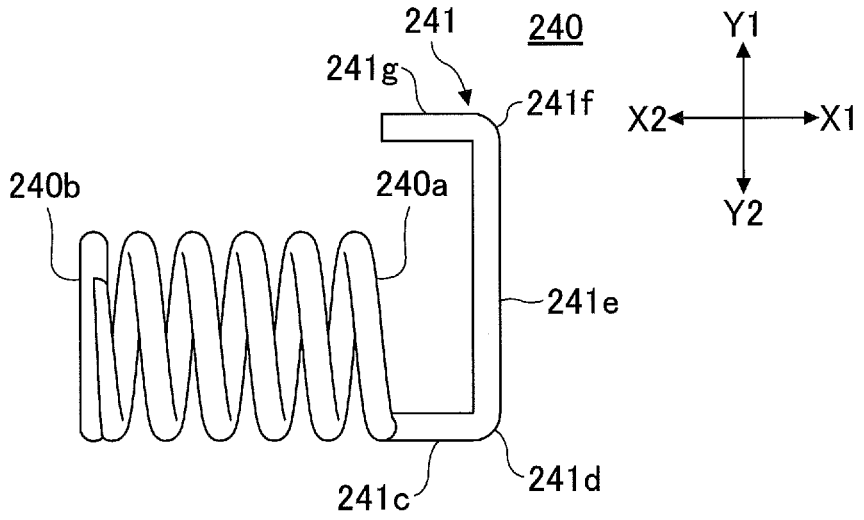
FIG. 16 illustrates the head spring of the second embodiment.

The head springs 240 are described with reference to FIGS. 15 and 16. Each head spring 240 is a coil spring and expands and contracts in the axial direction of the head spring 240, i.e., in the X1-X2 direction. The print head 10 is attached to the printer such that an end 240*a* of the head spring 240 contacts the frame 230 and an end 240*b* of the head spring 240 contacts the back surface of the print head 10, and is contracted in the X1-X2 direction to press the print head 10 toward the platen roller 20. A support 241 to be attached to the hook 232 is provided at the end 240*a*. The support 241 is formed by bending and includes a first extending part 241*a*, a first bent part 241*b*, a second extending part 241*c*, a second bent part 241*d*, a third extending part 241*e*, a third bent part 241*f*, and a fourth extending part 241*g*.

The extending part 241*a* extends in the Z1 direction from the end 240*a* and is bent substantially at right angle in the X1 direction at the bent part 241*b* to form the extending part 241*c*. The extending part 241*c* is bent at substantially right angle in the Y1 direction at the bent part 241*d* to form the extending part 241*e* extending linearly. Further, the extending part 241*e* is bent at substantially right angle in the X2 direction at the bent part 241*f* to form the extending part 241*g*.

The extending part 241*a* and the extending part 241*e* are orthogonal to each other, and the extending part 241*c* and the extending part 241*g* are parallel to the X1-X2 direction.

In the present embodiment, the extending part 241*e* is placed in the hook 232 so that the head spring 240 is supported by the frame 230. With this configuration, even when the print head 10 is detached, the head spring 240 is not detached from the frame 230, and it is possible to prevent the head spring 240 from being lost. Note that the axial direction of the head spring 240 is substantially orthogonal to the Y1-Y2 direction in which the extending part 241*e* extends.

According to the second embodiment, the head spring 240 can be rotated upward around the extending part 241*e* placed inside of the hook 232. When attaching and detaching the print head 10, the head spring 240 can be rotated so that the biasing force of the head spring 240 is not applied to the print head 10 and the print head 10 can be easily detached and attached.

In FIGS. 11 through 13, the print head 10 is pressed toward the platen roller 20 by the head springs 240. In this state, the head spring 240 is disposed inside of the frame 230, on the side of the print head 10.

Figure 17:
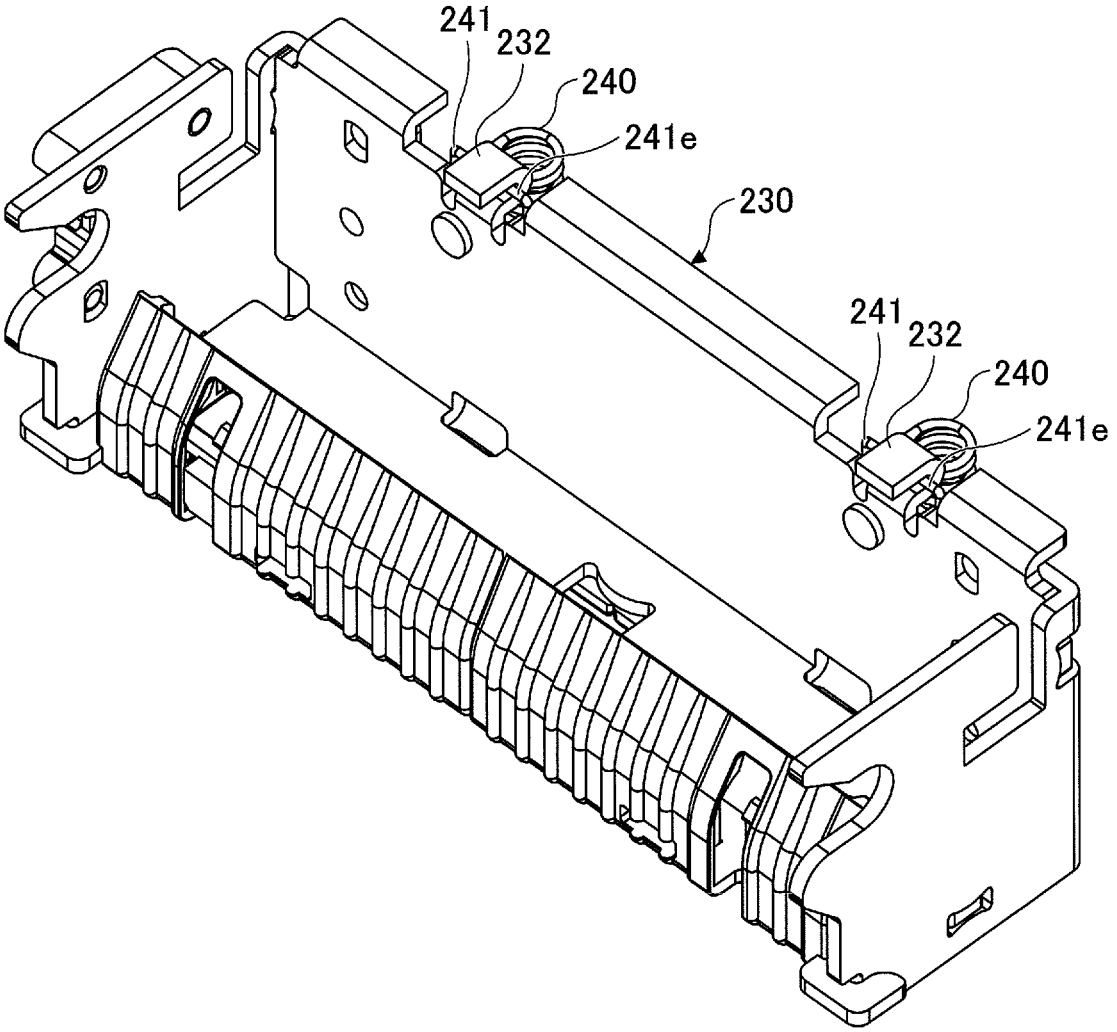
FIG. 17 illustrates the printer of the second embodiment.
Figure 18:
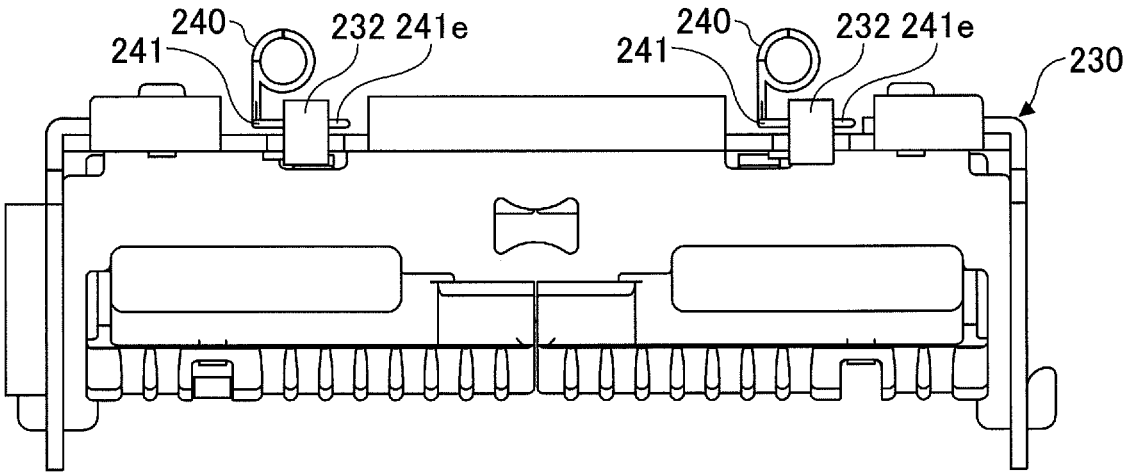
FIG. 18 illustrates the printer of the second embodiment.
Figure 19:
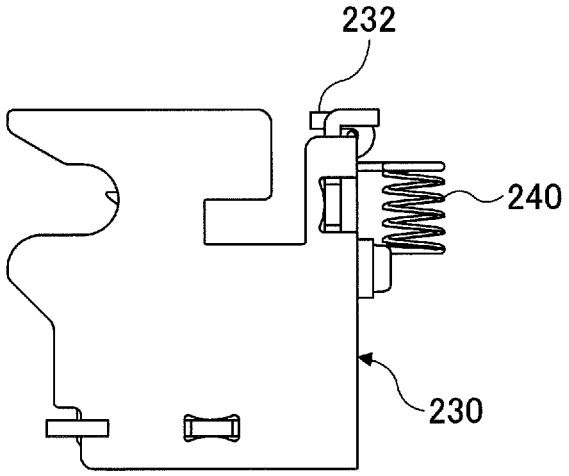
FIG. 19 illustrates the printer of the second embodiment.
Figure 20A:
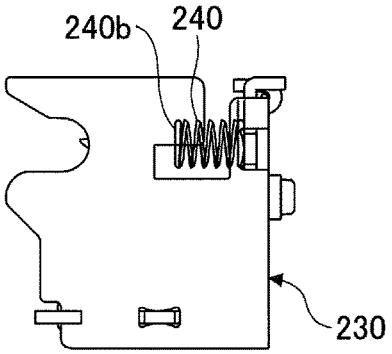
FIGS. 20A through 20G illustrate rotation of the head spring of the second embodiment.
Figure 20B:
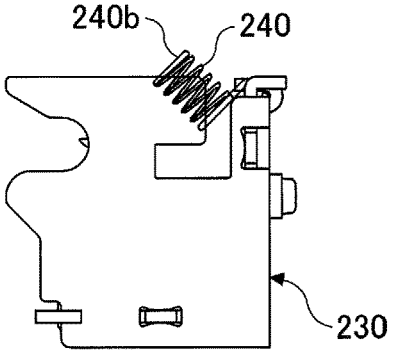
Figure 20C:
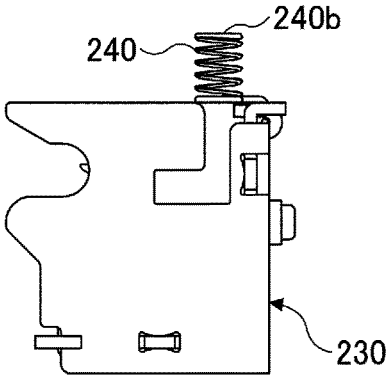
Figure 20D:
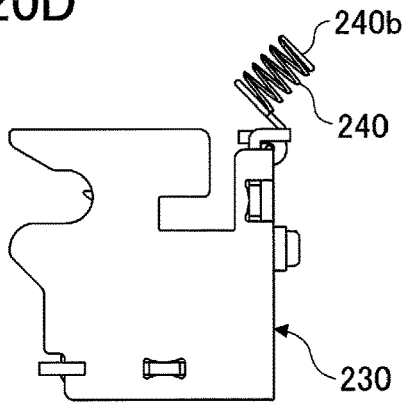
Figure 20E:
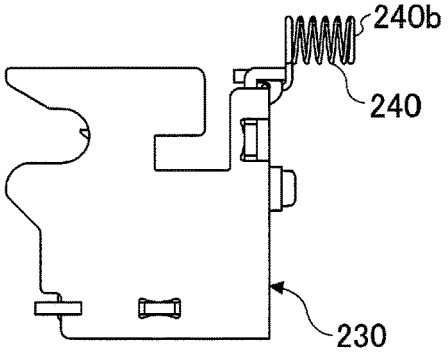
Figure 20F:
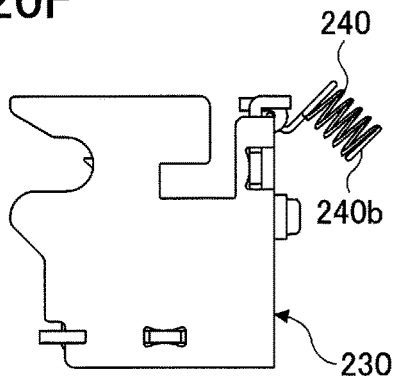
Figure 20G:
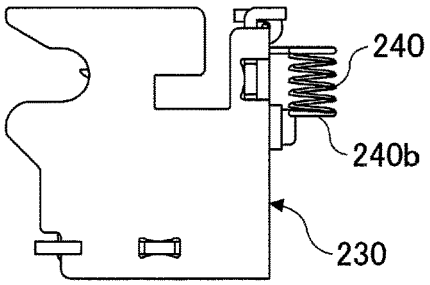

FIGS. 17 through 19 illustrate a state where the platen roller 20 and the print head 10 are detached. FIG. 17 is a perspective view, FIG. 18 is a top view, and FIG. 19 is a side view of the printer in a state where the head spring 240 is rotated. When detaching the print head 10, as illustrated in FIGS. 17 through 19, each head spring 240 is rotated about 270 degrees around the extending part 241*e* so that the biasing force of the head spring 240 is not applied to the print head 10, and then the print head 10 is detached. In this state, the head spring 240 is disposed outside of the frame 230, on the side opposite the print head 10.

When attaching the print head 10, the print head 10 is placed in the frame 230 in this state, and each head spring 240 is rotated around the extending part 241*e* so that the biasing force of the head spring 240 is applied to the print head 10 as illustrated in FIGS. 11 through 13.

FIGS. 20A through 20G illustrate the rotation of the head spring 240 around the extending part 241*e*. From the state of FIG. 20A where the biasing force of the head spring 240 is applied to the print head 10, the head spring 240 can be rotated to the state of FIG. 20B where the head spring 240 is rotated about 45 degrees clockwise, to the state of FIG. 20C where the head spring 240 is rotated about 90 degrees clockwise, to the state of FIG. 20D where the head spring 240 is rotated about 135 degrees clockwise, to the state of FIG. 20E where the head spring 240 is rotated about 180 degrees clockwise, to the state of FIG. 20F where the head spring 240 is rotated about 225 degrees clockwise, and to the state of FIG. 20G where the head spring 240 is rotated about 270 degrees clockwise. When detaching the print head 10, the head spring 240 is rotated in the order of FIG. 20A to FIG. 20G. When attaching the print head 10, the head spring 240 is rotated in the reverse order.

Configurations of the second embodiment other than those described above are substantially the same as the configurations of the first embodiment.

Printers according to the embodiments of the present invention are described above. However, the present invention is not limited to the above-described embodiments.

What is claimed is:

1. A printer, comprising:

a print head;

a frame;

a platen roller attached to the frame;

a head spring that biases the print head toward the platen roller;

a hook provided on a facing surface of the frame facing a back surface of the print head; and a support provided at an end of the head spring and attached to the hook, wherein the head spring is rotatable about the support.

2. The printer as claimed in claim 1, wherein the head spring is rotatable about the support from a position where an axial direction of the head spring is substantially orthogonal to the facing surface to a position where the axial direction of the support is substantially parallel to the facing surface.

3. The printer as claimed in claim 1, wherein the head spring is rotatable about the support from an inside of the frame to an outside of the frame.

4. The printer as claimed in claim 1, wherein the head spring is a coil spring;

the support includes an extending part placed in the hook; and a direction in which the extending part extends is substantially orthogonal to an axial direction of the head spring.

* * * * *